United States Patent [19]

Panella et al.

[11] Patent Number: 4,653,755

[45] Date of Patent: Mar. 31, 1987

[54] ALL STARS BASEBALL

[76] Inventors: Richard J. Panella, 105 Jennifer Ct., Yorktown, N.Y. 10598; George Spector, 233 Broadway RM 3615, New York, N.Y. 10007

[21] Appl. No.: 840,202

[22] Filed: Mar. 17, 1986

[51] Int. Cl.[4] ..... A63F 3/00

[52] U.S. Cl. ..... 273/93 R

[58] Field of Search ..... 273/93 R, 93 A, 244

[56] References Cited

U.S. PATENT DOCUMENTS

| | | | |
|---|---|---|---|
| 944,504 | 12/1909 | De Rocher | 273/93 R |
| 1,042,142 | 10/1912 | Pohlig | 273/93 R |
| 1,536,639 | 5/1925 | Van Beek | 273/93 R |
| 1,581,189 | 4/1926 | Fuchs | 273/93 R |
| 2,825,564 | 3/1958 | Macht et al. | 273/93 R |
| 4,261,569 | 4/1981 | Frohlich | 273/93 R X |

OTHER PUBLICATIONS

Newsweek 8/23/1976 p. 60, Strat-O-Matic Baseball.

*Primary Examiner*—Paul E. Shapiro

[57] ABSTRACT

An allstar baseball game is provided and consists of a baseball game played on a playing board with each player picking a set of baseball picture player cards to represent batters in the play of the game, playing pieces to be used on the playing board and an instruction chart of possible occurrences of baseball batting action depending upon the roll of a die.

3 Claims, 8 Drawing Figures

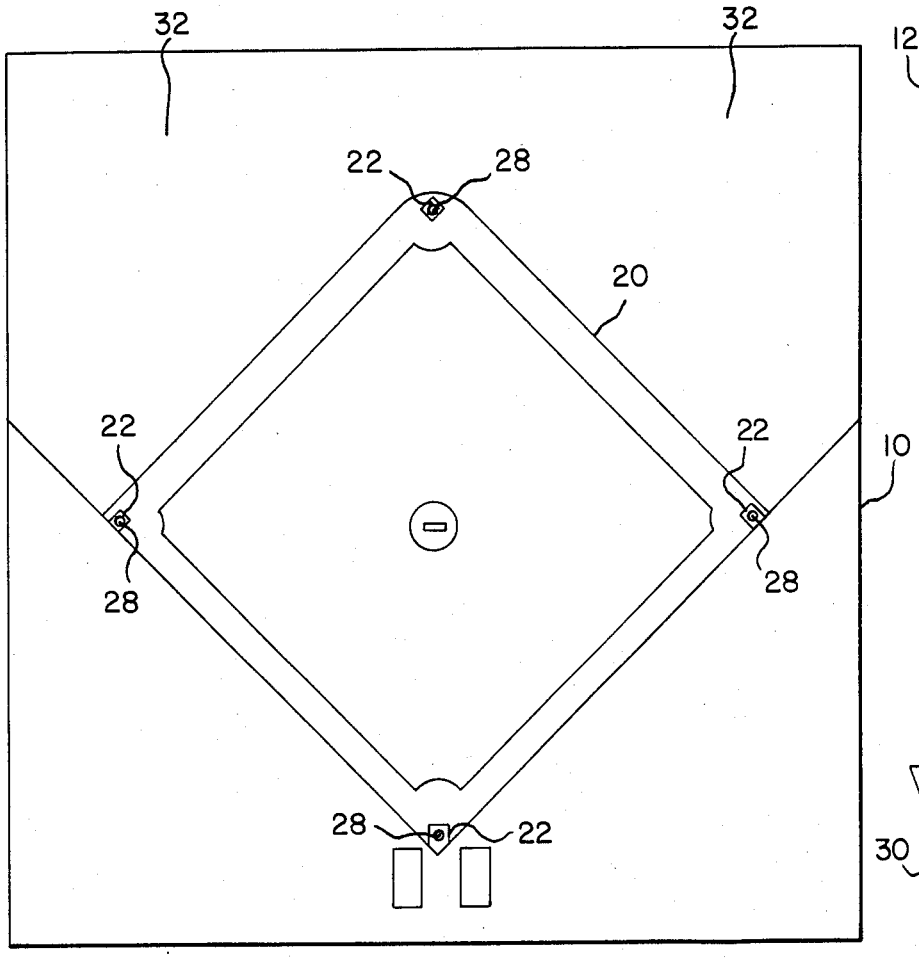
Fig. 1
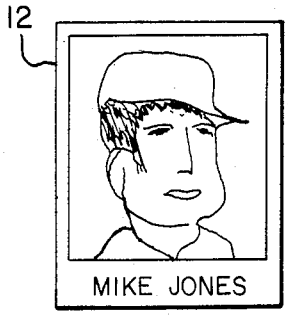
Fig. 2
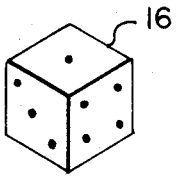
Fig. 3
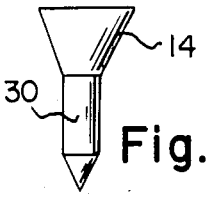
Fig. 3A
| INSTRUCTION CHART | |
|---|---|
| 1.1 | WALK |
| 1.2 | STRIKEOUT |
| 1.3 | SINGLE |
| 1.4 | FLYOUT |
| 1.5 | GROUNDOUT |
| 1.6 | FLYOUT |
| 2.1 | D.P. IF MAN ON 1ST OR ELSE GROUNDOUT |
| 2.2 | STRIKEOUT |
| 2.3 | DOUBLE |
| 2.4 | STRIKEOUT/H.B.P. |
| 2.5 | WALK |
| 2.6 | FLYOUT OR SAC. FLY ATTEMPT SAFE ODD DP EVEN IF MAN ON 3rd |
| 3.1 | TRIPLE |
| 3.2 | ATT BUNT/EVEN ROLL BAT OUT ALL RUNNERS ADV ODD R./Bat 1 & Safe |
| 3.3 | D.P. IF MAN ON 1ST ONLY OR GROUNDOUT |
| 3.4 | STRIKEOUT |
| 3.5 | WALK |
| 3.6 | FLYOUT |
Fig. 4
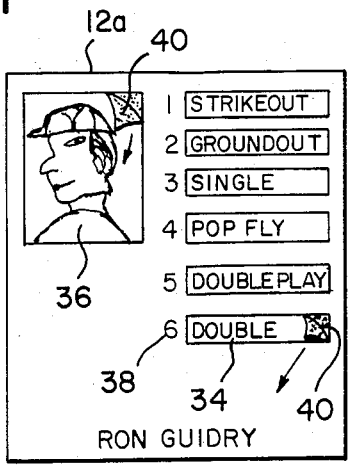
Fig. 5
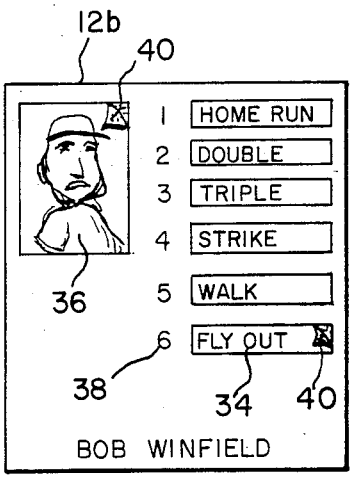
Fig. 6
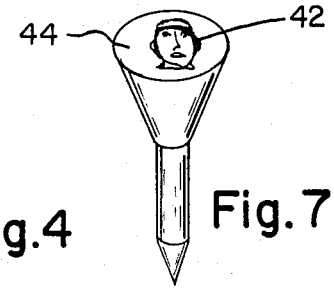
Fig. 7

ALL STARS BASEBALL

BACKGROUND OF THE INVENTION

The instant invention relates generally to games and more specifically it relates to an allstar baseball game that involves the rules of baseball played on a playing board.

Numerous games have been provided in prior art that are adapted to simulate baseball games. For example, U.S. Pat. Nos. 2,886,319; 2,933,316 and 4,210,335 all are illustrative of such prior art. While these units may be suitable for the particular purpose to which they address, they would not be as suitable for the purposes of the present invention as heretofore described.

SUMMARY OF THE INVENTION

A principle object of the present invention is to provide an allstar baseball game that combines a baseball game played on a playing board with each player picking a set of baseball picture player cards to represent batters in the play of the game.

Another object is to provide an allstar baseball game that has an instruction chart of possible occurrences of baseball batting action depending upon the roll of a die.

An additional object is to provide an allstar baseball game that combines each picture player card with its own instruction chart which is especially tabulated for the player illustrated thereon.

A further object is to provide an allstar baseball game that is economical in cost to manufacture.

A still further object is to provide an allstar baseball game that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a top plan view of the playing board.

FIG. 2 is a top plan view of a typical picture player card of a batter from a deck of cards.

FIG. 3 is a perspective view of a die employed in the game.

FIG. 3A is a front view of one of the playing pieces employed in the game.

FIG. 4 is a top plan view of a portion of the instruction chart.

FIG. 5 is a top plan view of a modified combination picture player card and instruction chart of a weak batter showing a removable picture and removable batting information labels.

FIG. 6 is a top plan view of a modified combination picture player card and instruction chart of a good batter similar to FIG. 5.

FIG. 7 is a perspective view of a modified playing piece being a peg with a picture of one of the batters on the top.

DETAILED DESCRIPTION OF THE PREFERRED EMBODIMENTS

Turning now descriptively to the drawings, in which similar reference characters denote similar elements throughout the several views, FIGS. 1 through 4 illustrates an allstar baseball game that contains a playing board 10, a plurality of baseball picture player cards 12, a plurality of playing pieces 14, a die 16 and an instruction chart 18.

The playing board 10 has a baseball field 20 thereon with specific postions 22 corresponding to home plate, first base, second base and third base. The baseball picture player cards represent batters while the playing pieces 14 are used as the batters during play of the game.

The die 16 is a chance determing device for producing random output counts. The instruction chart 18 has a list of specified batting information 24 corresponding to the output counts so that the playing pieces 14 can be placed at different positions 22 on the playing board 10 during the play of the game. The output counts are various numbers that correspond to numbers 26 indicating the different batting information 24 on the instruction chart 18.

Each of the specific positions 22 on the playing board 10 has a hole 28 therein. Each of the playing pieces are a peg 30 so that the peg 30 can be placed within any hole 28 on the playing board determined by the die 16 and the instruction chart 18 during the play of the game.

The outfield 32 could be sectioned off for advertisements aimed towards children which possibly could be sold to companies. Scoring pads and team logo stickers (not shown) could also be included as an optional feature with the game.

FIGS. 5 and 6 show two modified baseball picture player cards **12*a* and 12*b* combining the features of the baseball picture player cards 12 and the instruction sheet 18. Each card has a list of specified batting information 34 geared to picture 36 of the batter thereon and corresponding to the output counts of the die 16. The output counts are various numbers that correspond to numbers 38 indicating different batting information on the baseball picture player cards 12*a* and 12*b***.

Each of the baseball picture player cards **12*a* and 12*b* further includes the picture 36 and the batting information 34 being removable labels so that the baseball picture player cards 12*a* and 12*b* can be changed making the batter a weak to strong hitter when the need arises. Card 12*a* is a weak hitter while card 12*b* is a strong hitter as illustrated in FIGS. 5 and 6. The removable picture 36 and the removable batting information labels 34 include adhesive backings 40 so that they can be peeled off the baseball picture player cards 12*a* and 12*b***.

FIG. 7 shows a modified peg **30*a* that includes a picture 42 of one of the batters on top 44 corresponding to one of the matching baseball picture player cards 12, 12*a*, 12*b*** etc.

RULES FOR PLAYING THE GAME

1. The cards 12 are picked by the players for any line-up desired.

2. After each turn at bat the players card 12 goies to the bottom of a pile and next batter is set to bat.

3. A turn at bat consists of a player rolling the die 16 twice whereby the number (output count) corresponds to the number 26 and batting information 24 on the instruction chart 18.

4. For example if the first batters first roll is a "1" and second roll is a "4" the batter files out.

5. Second batter rolls a "3" then a "1" which is a triple.

6. Third batter first roll is a "2" and next roll a "6". At this point the batter has a choice to keep it as a flyout—no runners advance or to attempt a sacrafice fly with a third roll of die 16.

7. If batter elects to try and score the runner from third the third roll of the die determines this by either an odd/even number.

8. If odd is rolled batter is out and runner scores from third base. All other runners could move up one base also.

9. If even is rolled batter is out and the runner thrown out at home plate causing a double play.

10. Standard rules for batting is applied to the game. Three outs to each half inning. Nine innings to a game. Highest score wins.

RULES FOR PLAYING THE GAME WITH CARDS 12*a*, 12*b*, ETC.

1. Same general rules apply as from above with the following exception.

2. A turn at bat consists of a player rolling the die 16 once whereby the number (output count) corresponds to the number 38 and the batting information 34 on one of the cards 12*a*, 12*b*, etc.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An all star baseball game comprising:

(a) a playing board having a baseball field thereon with specific positions corresponding to home plate, first base, second base and third base;

(b) a plurality of playing pieces used as batters during play of said game;

(c) chance determining means for producing random output counts;

(d) a plurality of baseball picture player cards representing said batters, each said card having a list of specified batting information geared to picture of batter thereon and corresponding to said outputs counts so that said playing piece can be placed at said different positions on said playing board during said play of said game further comprising:

(e) each of said specific positions on said playing board having a hole therein; and (f) each of said playing pieces being a peg so that said peg can be placed within any said recess on said playing board determined by said chance determining means and one of said picture player cards during play of said game, wherein said chance determining means comprises a die whereby said output counts are various numbers that correspond to numbers indicating different batting information on said baseball picture player cards, wherein each of said baseball picture player cards further includes said picture and said batting information being removeable labels so that said baseball picture player cards can be changed making said batter a weak to strong hitter when the need arises.

2. An all star baseball game as recited in claim 1, wherein said removeable picture and removeable batting information labels include adhesive backings so that they can be peeled off said baseball picture player cards.

3. An all star baseball game as recited in claim 2, wherein each of said pegs includes a picture of one of said batters on top corresponding to said matching baseball picture player card.

* * * * *